US006930231B1

(12) United States Patent
Luhmann

(10) Patent No.: US 6,930,231 B1
(45) Date of Patent: Aug. 16, 2005

(54) METHOD OF PRODUCING GUITAR PICKS FROM IDENTIFICATION CARDS

(76) Inventor: William Von Luhmann, 5526 Spicebush Dr., Indianapolis, IN (US) 46254-9632

( * ) Notice: Subject to any disclaimer, the term of this patent is extended or adjusted under 35 U.S.C. 154(b) by 77 days.

(21) Appl. No.: 10/721,122

(22) Filed: Nov. 25, 2003

(51) Int. Cl.[7] ..... G10D 3/16
(52) U.S. Cl. ..... 84/322; 84/320; 84/321
(58) Field of Search ..... 84/322, 320, 321

(56) References Cited

U.S. PATENT DOCUMENTS

| | | | | |
|---|---|---|---|---|
| 2,465,266 | A | 3/1949 | Rieder | |
| 2,801,663 | A | 8/1957 | Lindauer, Jr. | |
| 3,392,447 | A | 7/1968 | Hendricks et al. | |
| 3,595,118 | A * | 7/1971 | Paxton | 84/322 |
| 3,650,210 | A * | 3/1972 | Archer | 283/98 |
| 3,851,553 | A | 12/1974 | Gale | |
| 4,116,512 | A | 9/1978 | Wiser | |
| 4,194,423 | A | 3/1980 | Cutler, Jr. | |
| 4,383,365 | A | 5/1983 | Metzigian | |
| 4,666,512 | A | 5/1987 | Hansen et al. | |
| 5,303,472 | A | 4/1994 | Mbanugo | |
| 5,594,189 | A * | 1/1997 | Latteri | 84/322 |
| D412,010 | S | 7/1999 | Lindley et al. | |
| 5,973,243 | A | 10/1999 | Christenson | |
| 6,036,797 | A * | 3/2000 | Kanazawa et al. | 156/82 |
| 6,054,643 | A * | 4/2000 | Chance et al. | 84/322 |
| 6,581,839 | B1 * | 6/2003 | Lasch et al. | 235/487 |
| 6,791,017 | B2 * | 9/2004 | Oskorep | 84/322 |

* cited by examiner

*Primary Examiner*—Shih-Yung Hsieh
(74) *Attorney, Agent, or Firm*—Woodard, Emhardt, Moriarty, McNett & Henry LLP

(57) ABSTRACT

The present invention comprises a method of using a punch for cutting one or more guitar picks directly from an identification card. The punch includes a holding portion positioned on one side of the identification card and a die or blade portion aligned with the held identification card. The die or blade portion has the shape of a guitar pick. The holding portion has a corresponding recess formed therein in the shape of a guitar pick. When the punch is aligned with the recess in the holding portion and the two halves are brought together with an identification card therebetween, a guitar pick is punched out of the identification card material. The identification card may be positioned such that the resultingly produced guitar pick prominently displays a portion of the identification card logo (i.e. Visa®, Mastercard®, or the like), includes the security hologram, includes the name of the card holder, etc. In this way, the guitar pick may be customized or made to have a pleasing design element.

11 Claims, 2 Drawing Sheets

METHOD OF PRODUCING GUITAR PICKS FROM IDENTIFICATION CARDS

TECHNICAL FIELD OF THE INVENTION

The present invention generally relates to guitar picks and, more particularly, to a method of producing guitar picks from identification cards.

BACKGROUND OF THE INVENTION

Presently, guitar picks are manufactured in large quantities using standard industrial processes for forming plastic articles. Such guitar picks are relatively expensive given their plain and utilitarian nature. There is therefore a need for the ability to form guitar picks that is more cost effective and that allows for some design creativity in the finished product. The present invention is directed toward meeting these needs.

SUMMARY OF THE INVENTION

The present invention is a method of producing guitar picks from an identification card using a punch. The identification card may be composed of plastic, be a credit card, or a driver's license. The punch may have a holding section and a die section.

The present invention also includes a method of producing a guitar pick with a hologram upon one side. An identification card with a hologram is placed in a punch. The die-cutting assembly of the punch is aligned with the hologram on the identification card and a guitar pick comprising a hologram is punched out. The identification card may be any type of card used to provide information, access, rights, or status upon the owner such as a credit card or a driver's license. The punch may also have two handles fixed at a pivot to provide a mechanical advantage to the punch. The punch may further have a holding portion coupled to the first handle and a die portion coupled to the second handle.

DETAILED DESCRIPTION OF THE PREFERRED EMBODIMENTS

Figure 1:
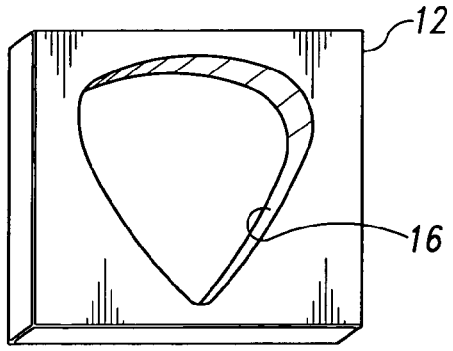
FIG. 1 is a perspective view of a preferred embodiment holding portion of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

"Identification card" as used herein refers to any type of card used to provide information, access, rights, or status upon the owner. Common forms of identification cards intended to be covered include, but are not limited to, credit cards, driver's licenses, student identification cards, organizational membership cards, debit and ATM cards, insurance cards, security badges, gift certificates, hotel electronic keys, business service cards such as cards to rent movies or obtain discounts on consumer purchases, calling cards, or any other card that has some commercial, legal, or personal significance.

The present invention comprises a method of using a punch for cutting one or more guitar picks directly from an identification card. The punch includes a holding portion positioned on one side of the identification card and a die or blade portion aligned with the held identification card. The die or blade portion has the shape of a guitar pick. The holding portion has a corresponding recess formed therein in the shape of a guitar pick. When the punch is aligned with the recess in the holding portion and the two halves are brought together with an identification card therebetween, a guitar pick is punched out of the identification card material. The identification card may be positioned such that the resultingly produced guitar pick prominently displays a portion of the identification card logo (i.e. Visa®, Mastercard®, or the like), includes the security hologram, includes the name of the card holder, etc. In this way, the guitar pick may be customized or made to have a pleasing design element.

Figure 2:
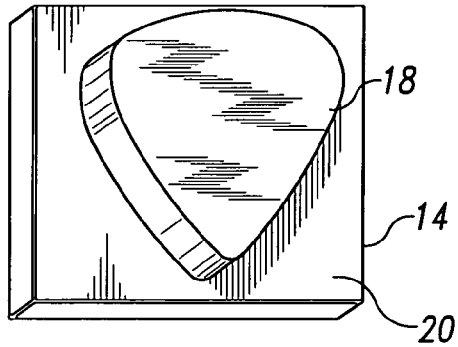
FIG. 2 is a perspective view of a preferred embodiment die portion of the present invention.

Referring to FIG. 1, there is shown a holding portion of the punch of the present invention, which works in concert with the die portion illustrated in FIG. 2. The punch 10 is constructed from the holding portion 12 of FIG. 1 and the die 14 of FIG. 2. The holding portion 12 is preferably formed from ⅛-inch thick steel plate having a recess 16 formed therein. Preferably the recess 16 extends completely through the holding portion 12, however those skilled in the art will recognize that the recess 16 may simply form a cavity in the holding portion 12. The recess 16 is formed in the shape of a guitar pick and has a relatively sharp edge formed therearound. The die portion 14 illustrated in FIG. 2 has a raised portion 18 formed on a base plate 20. The raised portion 18 is also in the shape of a guitar pick and the raised portion 18 is sized so as to fit snugly within the recess 16. Together, the holding portion 12 and the die portion 14 cooperate to form a die-cutting assembly 11 that may be used to punch guitar picks from an identification card.

Figure 3:
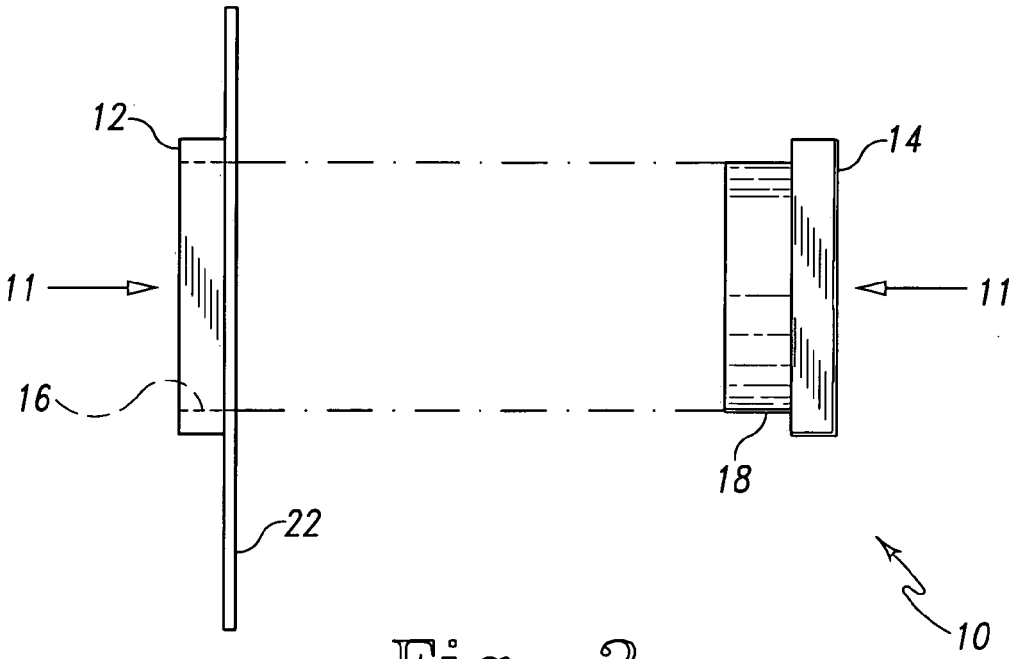
FIG. 3 is a schematic side elevational view of a preferred embodiment of the present invention aligned with an identification card prior to punching a guitar pick.

As shown in FIG. 3, the identification card 22 is placed adjacent to the holding portion 12 such that the portion of the identification card 22 that is desired to be formed into a guitar pick is situated over the recess 16. The die portion 14 is then advanced toward the identification card 22 such that the raised portion 18 lies directly over the recess 16.

Figure 4:
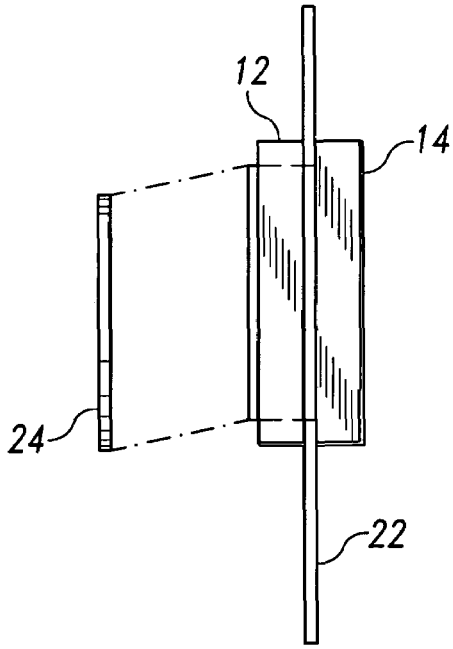
FIG. 4 is a schematic side elevational view of a preferred embodiment of the present invention punching through a credit card and ejecting a plastic guitar pick.

As shown in FIG. 4, further movement of the die portion 14 toward the holding portion 12 results in the raised portion 18 extending into the recess 16, thereby causing the portion of the identification card 22 which lies therebetween to be severed from the remainder of the identification card 22. The guitar pick 24 thus formed is ejected out of the opposite side of the recess 16 (if the recess 16 extends all the way through the base portion 12), or the guitar pick 24 is held within the recess 16 (if the recess 16 does not extend all the way through the base portion 12).

Figure 5:
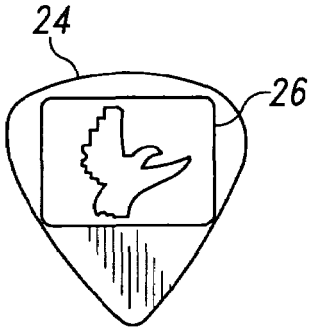
FIG. 5 is a top plan view of a guitar pick produced according to the present invention, incorporating a hologram thereon.
Figure 6:
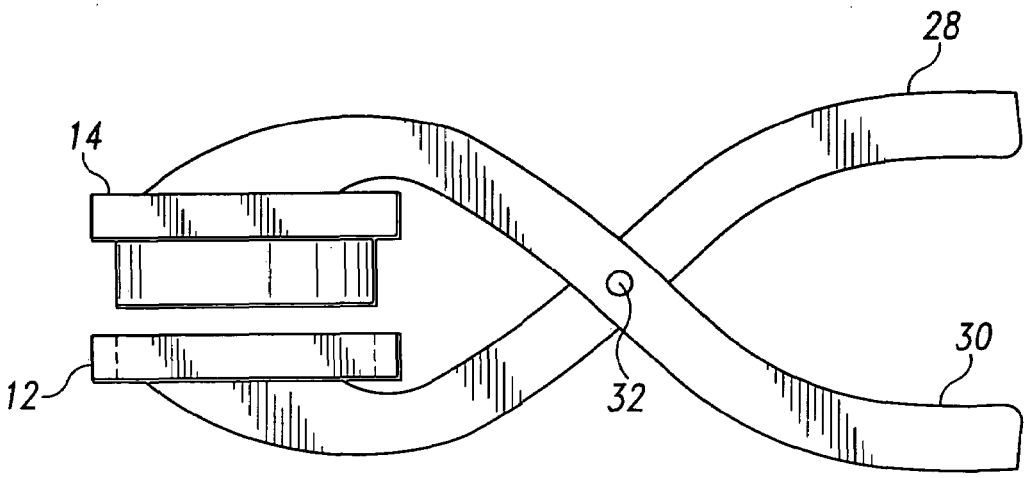
FIG. 6 is a side elevational view of a second embodiment of the present invention, incorporating force-multiplying handles.

As shown in FIG. 5, the guitar pick 24 thus formed preferably includes a design element 26 thereon which formed a part of the original identification card 22. The die portion 14 is aligned over the design element 26. The die-cutting assembly 11 produces a guitar pick 24 including a design element 26. By this method, guitar picks 24 may be formed which incorporate decorative elements from the donor identification card 22, such as the security hologram illustrated in FIG. 5.

In an alternative embodiment to the present invention, the holding portion 12 is coupled to a first handle 28, while the die portion 14 is coupled to a second handle 30. The handles 28 and 30 are coupled to one another at a pivot 32. This arrangement is formed such that when the handles 28 and 30 are squeezed together, the die 14 and holding portion 12 are perfectly aligned to punch out a guitar pick from an identification card 22 placed therebetween. Use of the handles 28, 30 facilitates alignment of the die 14 with the holding portion 12, and further provides a force-multiplying mechanical advantage to the squeezing action performed by the user.

It will be appreciated by those having ordinary skill in the art that use of the method of the present invention allows plastic cards to be recycled in order to inexpensively manufacture guitar picks, as well as allowing guitar picks having decorative design elements thereon to be made from such plastic cards.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of producing guitar picks comprising:

(a) providing an identification card;

(b) providing a punch; and (c) punching out a guitar pick from said identification card using said punch.

2. The method as described in claim 1 wherein said identification card is composed of plastic.

3. The method as described in claim 1 wherein said punch further comprises a holding section and a die section.

4. The method as described in claim 1 wherein said identification card is a credit card.

5. The method as described in claim 1 wherein said identification card is a driver's license.

6. A method of producing a guitar pick with a hologram upon one side comprising:

(a) providing an identification card further comprising a hologram;

(b) providing a punch with a die-cutting assembly;

(c) positioning said identification card so that the hologram is aligned with said die cutting assembly of said punch;

(d) punching a guitar pick out of said identification card, wherein said guitar pick comprises said hologram.

7. The method as described in claim 6 wherein said identification card is composed of plastic.

8. The method as described in claim 6 wherein said identification card is a credit card.

9. The method as described in claim 6 wherein said identification card is a driver's license.

10. The method as described in claim 6 wherein said punch further comprises a first handle coupled to a second handle wherein said coupling allows the handles to pivot providing a mechanical advantage.

11. The method as described in claim 10 wherein said die-cutting assembly further comprises a holding portion coupled to said first handle and a die portion coupled to said second handle.

* * * * *